US008991073B2

(12) United States Patent
Moretti

(10) Patent No.: US 8,991,073 B2
(45) Date of Patent: Mar. 31, 2015

(54) INSERT FOR SOLES, PARTICULARLY FOR PERFORATED SOLES MADE OF POLYMERIC MATERIAL, AND SOLE COMPRISING SAID INSERT

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 878 days.

(21) Appl. No.: 13/002,022

(22) PCT Filed: Jun. 18, 2009

(86) PCT No.: PCT/EP2009/057564

§ 371 (c)(1),
(2), (4) Date: Dec. 29, 2010

(87) PCT Pub. No.: WO2010/000617

PCT Pub. Date: Jan. 7, 2010

(65) Prior Publication Data

US 2011/0113655 A1 May 19, 2011

(30) Foreign Application Priority Data

Jun. 30, 2008 (IT) ..... PD2008A0196

(51) Int. Cl.
*A43B 7/12* (2006.01)
*A43B 13/16* (2006.01)
*A43B 7/06* (2006.01)

(52) U.S. Cl.
CPC . *A43B 7/125* (2013.01); *A43B 7/06* (2013.01); *A43B 13/16* (2013.01)
USPC ..... 36/44; 36/30 R; 36/25 R; 36/3 B

(58) Field of Classification Search
USPC ..... 36/44, 30 R, 25 R, 3 B, 31
See application file for complete search history.

(56) References Cited

U.S. PATENT DOCUMENTS 5,598,644 A 2/1997 Polegato Moretti
6,782,642 B2 * 8/2004 Knoche et al. ..... 36/129
(Continued)

FOREIGN PATENT DOCUMENTS

CN 1307454 8/2001
CN 1668221 9/2005
(Continued)

OTHER PUBLICATIONS

International Search Report issued Oct. 16, 2009 in PCT/EP09/057564 filed Jun. 18, 2009.
(Continued)

*Primary Examiner* — Ted Kavanaugh
(74) *Attorney, Agent, or Firm* — Oblon, McClelland, Maier & Neustadt, L.L.P.

(57) ABSTRACT

An insert for soles, particularly for perforated soles made of polymeric material, comprising a membrane that is impermeable to water and permeable to water vapor, the insert comprising a supporting layer made of mesh, felt or other diffusely perforated material, a vapor permeation component, which comprises the membrane arranged above the supporting layer, a layer of polymeric material that impregnates locally the supporting layer, so as to form therein a matrix for the adhesive bonding thereof to other components of the shoe, a region for sealing the supporting layer to the vapor permeation component. The adhesive bonding matrix affects at least the perimetric region of the supporting layer and delimits at least one vapor-permeable portion of the supporting layer, which is free from polymeric material. The sealing region provides for the intimate grip of the polymeric material, which impregnates the supporting layer, to the membrane.

18 Claims, 4 Drawing Sheets

(56) References Cited

U.S. PATENT DOCUMENTS

| | | | | |
|---|---|---|---|---|
| 7,367,141 | B2 | 5/2008 | Polegato Moretti | |
| 7,716,851 | B2 | 5/2010 | Polegato Moretti | |
| 2002/0100187 | A1 | 8/2002 | Polegato Moretti | |
| 2004/0013883 | A1 * | 1/2004 | Polegato Moretti | 428/422.8 |
| 2005/0126036 | A1 | 6/2005 | Wu | |
| 2006/0162183 | A1 * | 7/2006 | Polegato Moretti | 36/3 B |
| 2008/0209769 | A1 | 9/2008 | Polegato Moretti | |
| 2009/0211119 | A1 | 8/2009 | Polegato Moretti | |

FOREIGN PATENT DOCUMENTS

| | | | |
|---|---|---|---|
| CN | 1684598 | | 10/2005 |
| CN | 1993065 | | 7/2007 |
| DE | 20 2004 000 307 | | 11/2004 |
| DE | 10 2006 009 974 | | 9/2007 |
| JP | 2001-524854 | A | 12/2001 |
| JP | 3109236 | U | 5/2005 |
| JP | 2006-500128 | A | 1/2006 |
| JP | 2008-508004 | A | 3/2008 |
| JP | 2009-540886 | A | 11/2009 |
| TW | 200406162 | A | 5/2004 |
| WO | WO 98/51177 | A2 | 11/1998 |
| WO | 02 052970 | | 7/2002 |
| WO | WO 2004/028284 | A1 | 4/2004 |
| WO | 2006 010578 | | 2/2006 |
| WO | 2007 147421 | | 12/2007 |

OTHER PUBLICATIONS

Macao Search Report issued Sep. 14, 2010 in Corresponding Macao Application No. I/000968 filed Jun. 30, 2009.

Office Action issued Jun. 11, 2013 in Japanese Patent Application No. 2011-515318 (with English language translation).

U.S. Appl. No. 13/393,041, filed Feb. 28, 2012, Polegato Moretti.

U.S. Appl. No. 13/393,019, filed Feb. 28, 2012, Polegato Moretti.

Taiwanese Office Action issued in Application No. 098122122 on May 30, 2014 (w/ English translation).

* cited by examiner

INSERT FOR SOLES, PARTICULARLY FOR PERFORATED SOLES MADE OF POLYMERIC MATERIAL, AND SOLE COMPRISING SAID INSERT

TECHNICAL FIELD

The present invention relates to an insert for soles, particularly for perforated soles made of polymeric material comprising a membrane that is impermeable to water and permeable to water vapor, to the sole that comprises it and to their manufacturing method.

BACKGROUND ART

Waterproof and vapor-permeable soles made of polymeric material for shoes for sports use have now been known for several years.

A sole of this type is disclosed for example in WO2004/028284.

WO2004/028284 discloses a sole which has a structure that comprises a supporting layer which, at least in one preset macroportion, is made of mesh, felt or other diffusely perforated material.

A membrane made of a material that is impermeable to water and permeable to water vapor is associated in an upward region with the supporting layer at least in the preset macroportion that it covers.

A tread made of polymeric material with at least one through opening at the provided macroportion is joined hermetically to the membrane and to the supporting layer at least at the perimeter of the macroportion.

The presence of the opening defines a large section for the exchange of heat and vapor of the membrane with the outside, and therefore said sole structure is capable of utilizing the vapor permeability of the membrane that is impermeable to water and permeable to water vapor.

Soles of this type are particularly adapted for dissipating large quantities of water vapor that form inside the shoes of individuals who have higher-than-average perspiration.

Excessive sweating of the feet can also occur in the case of extremely hot and humid climates as well as in the case of use of shoes in sports activities.

This sole is provided by assembling, by adhesive bonding, the several layers and elements, which are provided separately: the tread, the membrane, the midsole, et cetera.

The mechanical resistance of the macroportion made of mesh, felt or other diffusely perforated material, arranged below the membrane and acting as a supporting element, is particularly important in the manufacturing of said sole.

Simple adhesive bonding of the tread onto the supporting layer, perimetrically with respect to the macroportion, is in fact unlikely to allow their intimate grip, which is needed to provide the required structural strength to the sole.

A sole provided according to the teaching disclosed in WO2006/010578 provides for the overmolding of the lower layer of the sole, which has a macrohole, onto a support and protection layer made of mesh.

In this manner, the lower layer, which also comprises the tread, is jointly connected to the mesh during its molding by injection of polymeric material in the fluid state, which passes through the mesh, embedding it and thus gripping it intimately.

This molding method provides for the insertion of the mesh-membrane package in a first mold and then the lower layer provided with the tread is co-molded onto said package. The material of the lower layer, injected in the liquid state within the mold, by passing to the meshes of the mesh, adheres to the membrane and, by solidifying, thus generates a seal that is impermeable to water, which can no longer seep between the two elements.

The semi-finished component obtained in this manner is inserted in a second mold, in which the upper layer of the sole is co-molded. In this case also, the material of the upper layer, injected in the liquid state inside the mold, adheres to the membrane, and by solidifying generates a seal that is impermeable to water.

Though having considerable effectiveness of the seal of the membrane, this method suffers some drawbacks.

Due to the molding of the polymeric material in the fluid state of the lower layer, seepages of material in fact occur through the mesh which are due to the difficulty in closing the mold completely.

Since it is not possible to compress the mesh completely against the membrane, the material in the fluid state can in fact pass through the meshes of said mesh.

The shape of the mesh in fact does not allow the mold to close hermetically and avoid these seepages, which compromise the aesthetics of the sole and reduce the vapor-permeable portion thereof provided at the macrohole.

This method therefore leads to a large number of production rejects.

Moreover, the method for co-molding the membrane with the tread constrains the choice of materials to be used as tread, since for example it is not possible to use a tread made of vulcanized rubber and of all the materials that do not convert to the liquid state in order to be injected.

The need is therefore felt to provide soles, that are impermeable to water in the liquid state, and permeable to water vapor and obviate the mentioned drawbacks, being able to evacuate large quantities of water vapor from the inside of the shoe.

DISCLOSURE OF THE INVENTION

The aim of the present invention is to propose an insert for a sole that meets this need.

Within this aim, an object of the invention is to provide a waterproof and vapor-permeable insert for a sole that has a large vapor permeation area while ensuring a structural strength thereof that is at least equal to the structural strength of currently known soles.

Another object of the invention is to provide an insert that allows to provide a sole, which comprises it, with the materials that are most adapted for the tread, such as rubber and those materials whose production process does not provide for liquefaction.

Another object of the invention is to provide an insert for a waterproof and vapor-permeable sole that has a high degree of adhesion to the other components of the sole, thus making it strong and durable.

Another object of the invention is to propose an insert for a sole that is structurally simple and can be manufactured at low costs.

This aim, these and other objects that will become better apparent hereinafter are achieved by an insert for soles, particularly for perforated soles made of polymeric material, which comprise a membrane that is impermeable to water and permeable to water vapor, characterized in that it comprises

- a supporting layer made of mesh, felt or other diffusely perforated material,
- a vapor permeation component, which comprises a membrane that is impermeable to water and permeable to water vapor and is arranged above said supporting layer, a layer of polymeric material that impregnates locally said supporting layer, forming therein a matrix for the adhesive bonding thereof to other components of the shoe, said adhesive bonding matrix affecting at least the perimetric region of said supporting layer and delimiting at least one portion of said supporting layer that is free from said polymeric material for its permeability to water vapor, a region for sealing said supporting layer to said vapor permeation component which provides, at least at the perimetric edge of said membrane, the intimate grip of said polymeric material, which impregnates said supporting layer, to said membrane, so as to seal the region comprised between them.

Moreover, this aim, as well as these and other objects that will become better apparent hereinafter, are achieved by an insert for soles, particularly for perforated soles made of polymeric material, which comprise a membrane that is impermeable to water and permeable to water vapor, characterized in that it comprises a supporting layer made of mesh, felt or other diffusely perforated material, a vapor permeation component, which comprises a membrane that is impermeable to water and permeable to water vapor and is arranged above said supporting layer, a layer of polymeric material that impregnates locally said supporting layer, forming therein a matrix for the adhesive bonding thereof to other components of the shoe, said adhesive bonding matrix affecting at is least the perimetric region of said supporting layer and delimiting at least one vapor-permeable portion of said supporting layer that is free from said polymeric material for its permeability to water vapor.

BRIEF DESCRIPTION OF THE DRAWINGS

Further characteristics and advantages of the invention will become better apparent from the description of some preferred but not exclusive embodiments of the insert for soles, of the sole and of its manufacturing method, according to the invention, which are illustrated by way of non-limiting example in the accompanying drawings, wherein.

Figure 1:
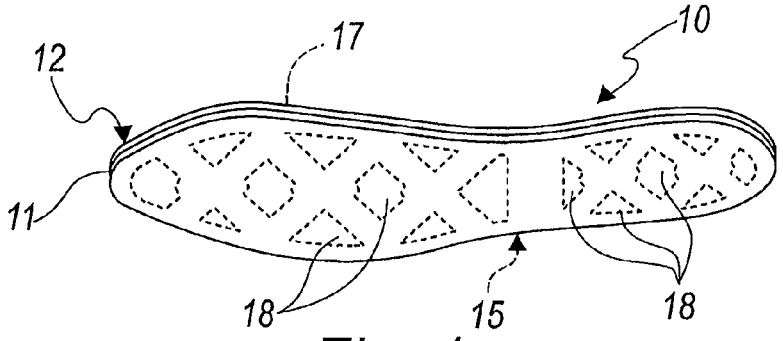
FIG. 1 is a bottom perspective view of an insert for soles according to the invention.
Figure 2:
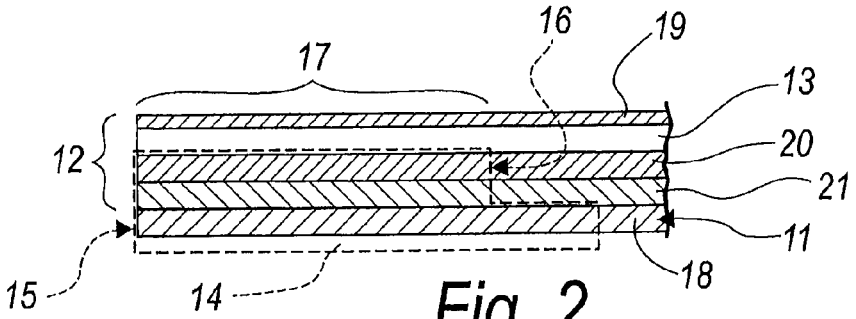
FIG. 2 is an enlarged-scale sectional view of a detail of the insert for soles according to the invention.

It is noted that anything found to be already known during the patenting process is understood not to be claimed and to be the subject of a disclaimer.

WAYS OF CARRYING OUT THE INVENTION

With reference to the cited figures, the reference numeral 10 generally is designates an insert for soles, particularly for perforated soles made of polymeric material, which comprise a membrane that is impermeable to water and permeable to water vapor, which has the particularity that it comprises:

a supporting layer 11 made of mesh, felt or other diffusely perforated material, a vapor permeation component 12, which comprises a membrane 13 that is impermeable to water and permeable to water vapor and is arranged above the supporting layer 11, a layer of polymeric material 14, which impregnates locally the supporting layer 11 and forms therein a matrix 15 for the adhesive bonding thereof to other parts that compose the shoe, a region 16 for sealing the supporting layer 11 to the vapor permeation component 12, which provides, at least at the perimetric edge 17 of the membrane 13, the intimate grip of the polymeric material 14, which impregnates the supporting layer 11, to the membrane 13 so as to seal the region comprised between them.

The adhesive bonding matrix 15 affects at least the perimetric region of the supporting layer 11 and delimits at least one vapor-permeable portion 18 of the supporting layer 11, which is free from the polymeric material 14 for its permeability to water vapor.

Said adhesive bonding matrix 15 is preferably provided by microinjection, screen printing or melting on the supporting layer 11 of a polymeric film, for example by means of a heating process by affecting the film with high-frequency electric current.

Preferably, the supporting layer 11 is made of a dense-knitted mesh with fibers made of a material selected among metallic material and synthetic material, such as nylon or natural fibers.

Moreover, the membrane 13 that is impermeable to water and permeable to water vapor is conveniently made of a material selected among is expanded polytetrafluoroethylene, e-PTFE, and/or polyurethane, PU, or equivalents.

The vapor permeation component 12 advantageously also comprises a fine mesh 19 made of synthetic material, which is associated with the membrane 13 to reinforce it, a protective layer 20, which is associated in a downward region with the membrane 13 for its protection against impacts, between said membrane and the supporting layer 11, an optional vapor-permeable layer 21 made of Kevlar® with high resistance to piercing and cutting, between the membrane 13 and the supporting layer 11.

The protective layer 20 is conveniently made of vapor-permeable material selected among felt and diffusely perforated material, which is adapted to absorb impacts.

The sealing region 16 extends so as to affect a portion of the protective layer 20 at least at the perimetric edge 17 that is impregnated by the polymeric material 14 so as to seal the supporting layer 11 to the membrane 13.

Likewise, the sealing region 16 also affects a portion of the vapor-permeable layer 21 with high resistance to piercing and cutting at least at the perimetric edge 17, which is impregnated by the polymeric material 14 so as to seal the supporting layer 11 to the membrane 13.

Advantageously, the parts that compose the vapor permeation component 12, i.e., the membrane 13 and conveniently the fine mesh 19, the protective layer 20 and the vapor-permeable layer 21 with high resistance to piercing and cutting, are mutually joined in a manner that does not compromise water vapor permeability and waterproofness and is selected among sewing, adhesive bonding, heat-sealing, welding with high-frequency electric current, ultrasound welding, by spots or lines.

Moreover, said parts that compose the vapor permeation component 12 conveniently have a portion, which at least corresponds to the perimetric region, that is impregnated with polymeric material 14 through their entire thickness comprised between the supporting layer 11 and the membrane 13.

These portions define the sealing region 16, which thus constitutes an at least perimetric seal of the region comprised between the supporting layer 11 and the membrane 13.

In a particular embodiment of the insert 10 for soles, on said portion that at least corresponds to the perimetric region there are holes adapted to facilitate the impregnation, by the polymeric material, of the components of the vapor-permeation component 12 that are comprised between the supporting layer 11 and the membrane 13.

Figure 3:
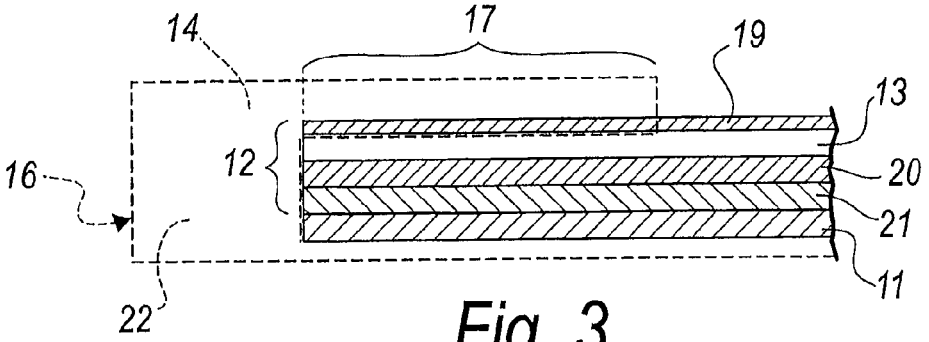
FIG. 3 is an enlarged-scale sectional view of a detail of the insert for soles in an alternative embodiment according to the invention.

In an alternative embodiment, illustrated by way of non-limiting example in FIG. 3, the insert 10 comprises a welt 22 made of polymeric material 14, which extends the adhesive bonding matrix 15 beyond the perimeter of the membrane 13, and wraps around at least the supporting layer 11 and the vapor-permeation component 12 so as to seal the supporting layer 11 at least to the membrane 13.

Conveniently, said polymeric material 14 is polyvinyl chloride, PVC, thermoplastic rubber, TR, or in an alternative and equivalent manner, is thermoplastic polyurethane, TPU.

Figure 4A:
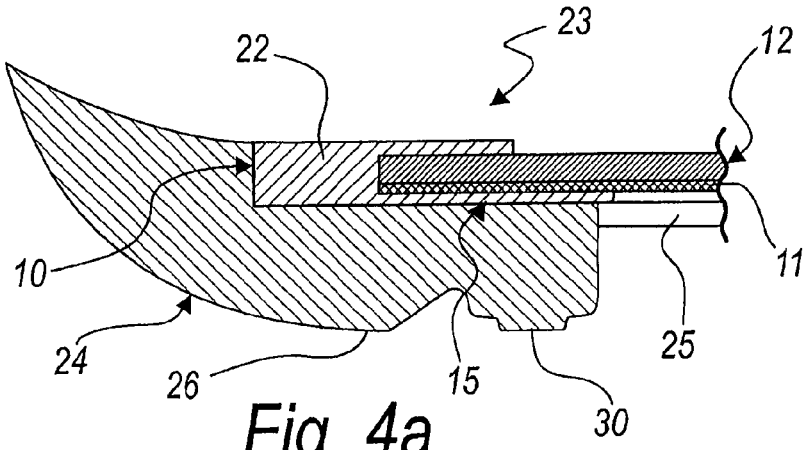
FIG. 4*a* is an enlarged-scale sectional view of a detail of a sole comprising an insert according to the invention in a first embodiment.
Figure 4B:
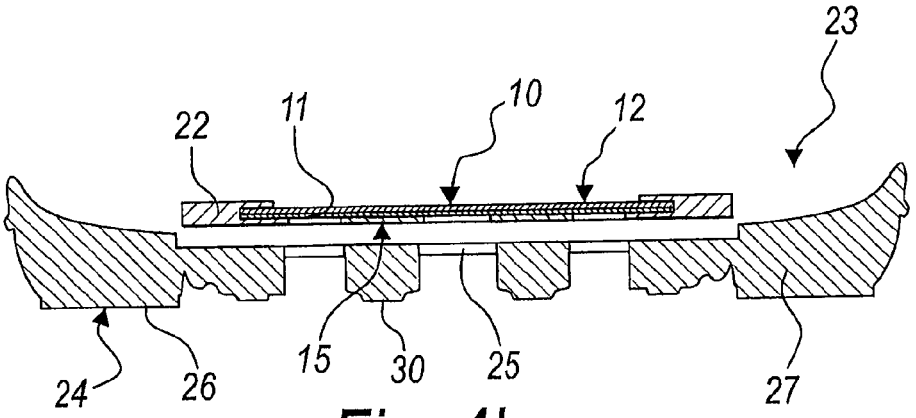
FIG. 4*b* shows a sole comprising the insert according to the invention, in a first embodiment, in a sectional and partially exploded view.

FIGS. 4*a* and 4*b* illustrated by way of non-limiting example a first embodiment of a sole 23 which, according to the invention, has the particularity of comprising an insert 10 according to the invention and preferably comprises a bearing frame 24 for the insert 10, which is connected thereto so as to form an impermeable seal by means of the adhesive bonding matrix 15.

The bearing frame 24 is conveniently provided with at least one opening 25 that corresponds to the vapor-permeable portions 18, for its permeability to water vapor and waterproofness.

Conveniently, the sole 23 has a plurality of openings 25.

The bearing frame 24 preferably is made of polymeric material, such as for example vulcanized rubber, thermoplastic polyurethane (TPU) or thermoplastic rubber (TR).

Conveniently, the opening 25 has a surface of at least 1 $cm^2$.

Figure 7:
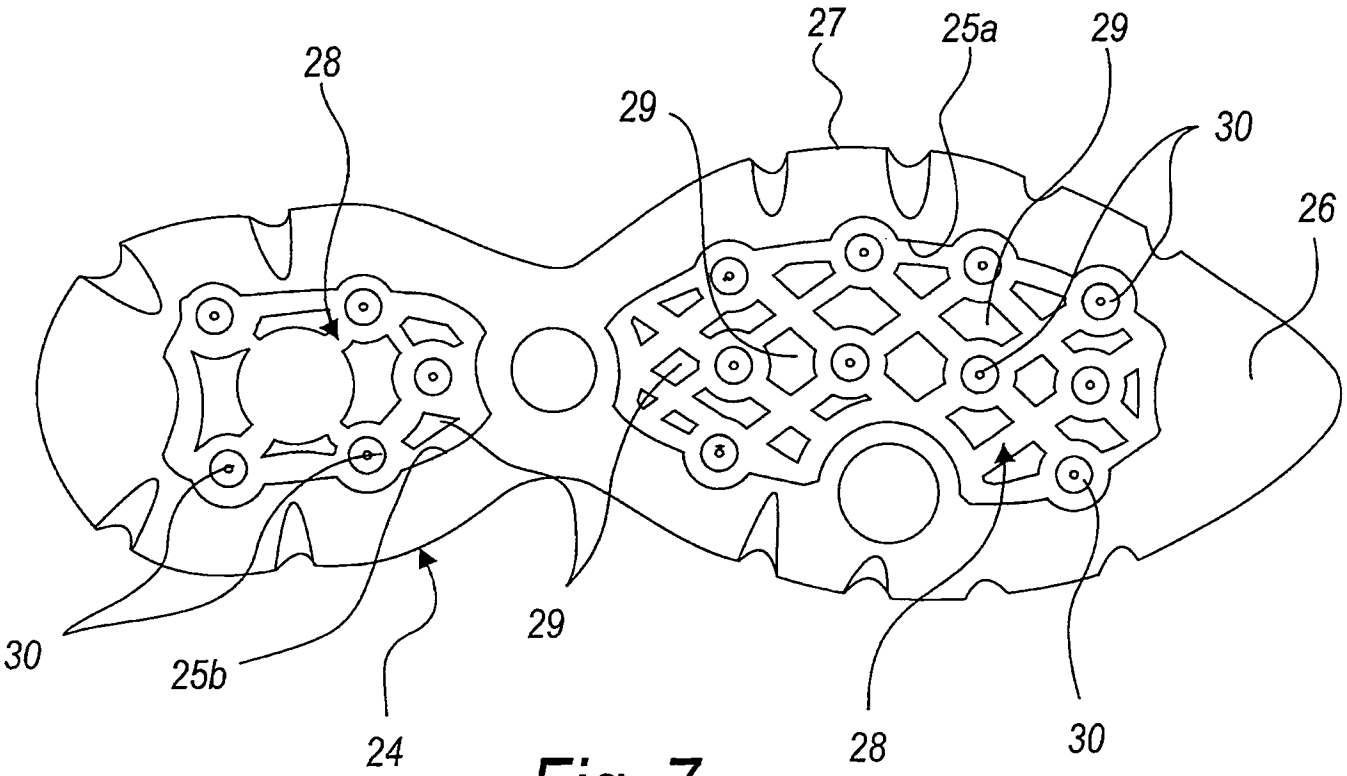
FIG. 7 is a bottom plan view of a sole that comprises an insert according to the invention.

With reference to FIG. 7, the bearing frame 24 conveniently has, on its face that lies opposite the face connected to the insert 10, a tread surface 26.

Moreover, the bearing frame 24 conveniently delimits a front opening 25*a* and a rear opening 25*b*, which are arranged respectively at the front region of the sole and at the heel region.

In particular, in this embodiment, the bearing frame 24 comprises a perimetric rim 27, which delimits the openings 25, and a structural grid 28, which is monolithic with respect to the perimetric rim 27 and covers the openings 25, dividing them into a plurality of windows 29 whose surfaces conveniently are at least equal to 5 $mm^2$.

The structural grid 28 preferably has studs 30 that protrude from it and are adapted for contact with the ground.

Figure 5:
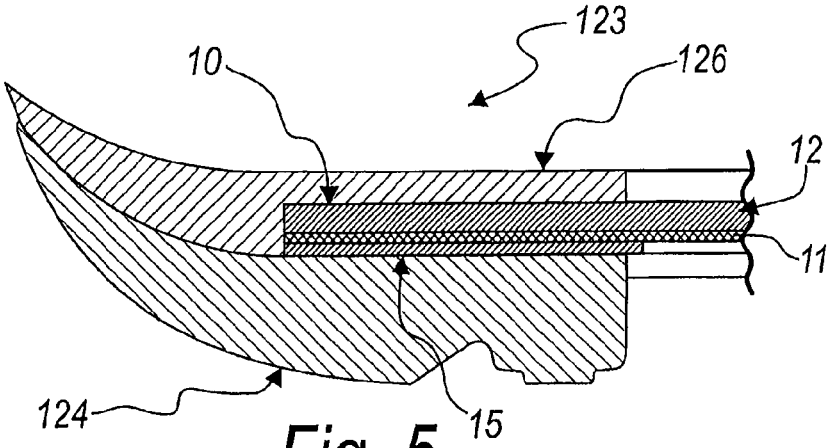
FIG. 5 is an enlarged-scale sectional view of a detail of a sole comprising an insert according to the invention in a second embodiment.

In a second embodiment, shown by way of non-limiting example in FIG. 5, a sole 123 according to the invention advantageously comprises a bearing frame 124 on which a midsole 126, conveniently made of ethyl vinyl acetate, EVA, is superimposed; said midsole is shock-absorbing and vapor-permeable or perforated at least at the vapor-permeable portions 18 of the insert 10.

Conveniently, the vapor-permeation component 12 is sealed perimetrically and impermeably to the midsole 126 at least at the perimeter of the membrane 13.

Figure 6:
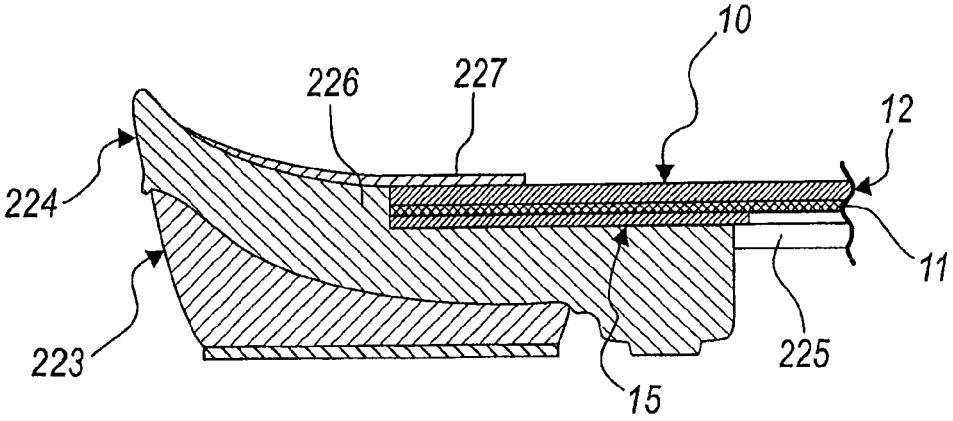
FIG. 6 is an enlarged-scale sectional view of a detail of a sole which comprises an insert according to the invention in a third embodiment.

In a third embodiment, illustrated by way of non-limiting example in FIG. 6, the sole 223 preferably comprises a bearing frame 224 that lies perimetrically to its portion affected by the openings 225.

Conveniently, the bearing frame 224 has, on its upper face, a perimetric containment edge 226 for the insert 10, and there is also a perimetric gasket 227, made of impermeable material, to seal the insert 10 to the bearing frame 224, which is arranged so as to straddle the matching edges of the containment edge 226 and of the insert 10.

Conveniently, the seal of the membrane 13, of the insert 10, to the bearing frame 224 is obtained by adhesive bonding or by co-molding of the perimetric gasket 227 so as to straddle the containment edge 226.

In practice it has been found that the invention achieves the intended aim and objects, providing an insert for waterproof soles that simultaneously have a high vapor-permeation capacity.

A sole with an insert according to the invention is in fact waterproof and vapor-permeable and, by having large extensive holes, is provided with a large vapor permeation area while having considerable structural strength, which is ensured by the supporting layer made of nylon or metal mesh, which easily and effectively adheres to the other components of the sole by way of the adhesive bonding matrix made of polymeric material.

The insert provided with the adhesive bonding matrix made of polymeric material further ensures high flexibility of its use in soles made of different materials, thus allowing the use of materials such as rubber for the tread.

Moreover, in all cases in which it is impossible to co-mold a supporting element made of mesh directly with the rest of the sole, it is advantageous to use an insert for soles which, according to the invention, is provided separately.

The insert for soles according to the invention in fact has an adhesive bonding matrix directly on the supporting element made of mesh, which is provided easily and precisely with different methods, such as for example melting a polymeric film by high frequency, microinjection or screen printing of a layer of polymeric material, avoiding the simultaneous processing of the entire sole.

In this manner, the technical and aesthetic limitations that are typical of the molding of a three-dimensional and complex object. such as a sole for shoes, which has a tread with large openings, are overcome.

The tread and the rest of the sole are in fact glued to the adhesive bonding matrix and are sealed to the waterproof and vapor-permeable membrane, obtaining a sole that is impermeable to water and permeable to water vapor.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent n° PD2008A000196 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. An insert for soles, particularly for perforated soles made of polymeric material, comprising a membrane that is impermeable to water and permeable to water vapor, the insert comprising:

a supporting layer made of mesh, felt or other diffusely perforated material;

a vapor permeation component, which comprises a membrane that is impermeable to water and permeable to water vapor and is arranged above said supporting layer; and a layer of polymeric material that impregnates locally said supporting layer, forming therein an adhesive bonding matrix for adhesive bonding thereof to a bearing frame of the sole, said adhesive bonding matrix affecting at least a perimetric region of said supporting layer and delimiting at least one vapor-permeable portion of said supporting layer that is free from said polymeric material for its permeability to water vapor, wherein the bearing frame includes, on its face that lies opposite a face connected to the insert, a tread surface and a structural grid, the structural grid having studs that protrude therefrom that are adapted for contact with a ground surface.

2. The insert for soles according to claim 1, further comprising:

a region for sealing said supporting layer to said vapor permeation component which provides, at least at the perimetric edge of the membrane, an intimate grip of said polymeric material, which impregnates said supporting layer, to said membrane, so as to seal the region comprised between them.

3. The insert for soles according to claim 2, wherein said supporting layer is made of a dense-knitted mesh with fibers made of a material selected among metallic material, synthetic material and natural fibers.

4. The insert for soles according to claim 2, wherein said membrane that is impermeable to water and permeable to water vapor is made of a material selected among expanded polytetrafluoroethylene (e-PTFE) and/or polyurethane (PU), or equivalents.

5. The insert for soles according to claim 1, wherein said vapor permeation component comprises a fine mesh made of synthetic material which is associated with said membrane for its reinforcement.

6. The insert for soles according to claim 2, wherein said vapor permeation component comprises a protective layer that is associated in a downward region of said membrane, for its protection against impacts, interleaved between it and said supporting layer, said protective layer being made of a material selected among felt and diffusely perforated material, adapted to absorb impacts, said sealing region extending along a portion of said protective layer, which at least corresponds to said perimetric region, which is impregnated by said polymeric material to seal said supporting layer to said membrane.

7. The insert for soles according to claim 2, wherein said vapor permeation component comprises a vapor-permeable layer with high resistance to piercing and cutting, which is interposed between said membrane and said supporting layer, said sealing region extending along a portion of said vapor-permeable layer with high resistance to piercing and cutting, which at least corresponds to said perimetric region, impregnated by said polymeric material to seal said supporting layer to said membrane.

8. The insert for soles according to claim 1, wherein the parts that compose said vapor-permeation component are mutually joined in a manner that does not compromise water vapor permeability and waterproofness, selected among sewing, spot gluing, heat sealing, welding with high-frequency current, ultrasound welding.

9. The insert for soles according to claim 2, wherein the parts that compose said vapor-permeation component have a portion that at least corresponds to said perimetric edge and is impregnated with said polymeric material through their entire thickness comprised between said supporting layer and said membrane to form said at least perimetric sealing region.

10. The insert for soles according to claim 2, further comprising a welt made of said polymeric material that extends said adhesive bonding matrix beyond the perimeter of said membrane and wraps around at least said supporting layer and said vapor-permeation component so as to seal at least said membrane to said supporting layer.

11. The insert for soles according to claim 1, wherein said polymeric material is polyvinyl chloride (PVC).

12. The insert for soles according to claim 1, wherein said polymeric material is thermoplastic polyurethane (TPU).

13. A sole comprising the insert for soles of claim 1.

14. The sole, according to claim 13, wherein the bearing frame is connected to said insert for soles so as to provide a waterproof seal at said adhesive bonding matrix and is provided with at least one opening that corresponds to said at least one vapor-permeable portion, for its permeability to water vapor and waterproofness at said at least one opening.

15. The sole according to claim 13, further comprising a midsole that is shock-absorbing and vapor-permeable or perforated, at least at said at least one vapor-permeable portion, said insert being connected perimetrically so as to form a waterproof seal to said midsole at least at said membrane that it comprises.

16. The sole according to claim 13, further comprising said bearing frame and has, on its upper face, a perimetric containment edge for said insert, there being also a perimetric gasket for sealing said membrane of said insert to said bearing frame, which is arranged so as to straddle said containment edge.

17. The sole according to claim 16, wherein said bearing frame has, on its face that lies opposite the face connected to said insert, said tread surface.

18. A shoe, comprising the sole of claim 13, provided with said insert.

* * * * *